US005687518A

United States Patent [19]

Endo et al.

[11] Patent Number: 5,687,518

[45] Date of Patent: Nov. 18, 1997

[54] WINDOW FRAME HAVING OUTER FRAME MEMBER MADE OF RESIN

[75] Inventors: Takayuki Endo, Narashino; Susumu Maeda, Ichikawa, both of Japan

[73] Assignee: Tokuyama Corporation, Yamaguchi, Japan

[21] Appl. No.: 745,773

[22] Filed: Nov. 8, 1996

[30] Foreign Application Priority Data

Nov. 10, 1995 [JP] Japan ..... 7-292481

[51] Int. Cl.[6] ..... E06B 1/04

[52] U.S. Cl. ..... 52/204.1; 52/656.7; 49/501; 49/DIG. 2

[58] Field of Search ..... 52/204.1, 206, 52/207, 204.5, 204.591, 204.62, 656.1, 656.2, 656.7, 656.5; 49/501, DIG. 2; 428/76, 165, 503, 356, 395

[56] References Cited

U.S. PATENT DOCUMENTS

| | | | |
|---|---|---|---|
| 4,118,267 | 10/1978 | Vogel | 52/656.2 X |
| 4,328,644 | 5/1982 | Scott et al. | 49/501 |
| 4,333,283 | 6/1982 | Ebata | 52/202 |
| 4,996,814 | 3/1991 | Guillemet | 52/656.5 |
| 5,515,652 | 5/1996 | Klimek | 49/507 |
| 5,553,420 | 9/1996 | Klimek | 49/501 |

*Primary Examiner*—Carl D. Friedman
*Assistant Examiner*—Creighton Smith
*Attorney, Agent, or Firm*— Kane,Dalsimer,Sullivan,Kurucz, Levy,Eisele and Richard, LLP

[57] ABSTRACT

In a resin window frame (2, 4), an outer frame member (2*a*, 4*a*) made of resin blended with cellulose-based fine powder has a hollow portion, and a wooden core member (2*b*, 4*b*) having shape and size corresponding to the hollow portion of the outer frame member (2*a*, 4*a*) is engagedly inserted into the hollow portion of the outer frame member (2*a*, 4*a*).

7 Claims, 5 Drawing Sheets

WINDOW FRAME HAVING OUTER FRAME MEMBER MADE OF RESIN

BACKGROUND OF THE INVENTION

1. Field of the Invention

The present invention relates to a window frame, and more particularly to a window frame which is designed in at least two-layered structure having a wooden core member and a resin outer frame member, and improved in mechanical strength and durability.

2. Description of the Related Art

A window frame made of resin has such an excellent characteristic that it suffers little condensation at an indoor side thereof in winter season because it has a low thermal conductivity. However, when the window frame is formed of a hollow member made of resin, it does not have sufficient mechanical strength, and also it suffers bending deformation or creep deformation. Therefore, it has been proposed that this type of resin window frame is reinforced with metal member. Nevertheless, when the metal member is used as reinforcing means for the window frame, the thermal conductivity of the window frame is increased, and consequently, not only the heating and cooling efficiency of the inside of the window is lowered, but also both the metal member and the resin member are liable to be exfoliated from each other due to the difference in thermal expansion or contraction coefficient between metal and resin, so that water invades the gaps or crevasses between the metal and resin members, which causes corrosion of the metal member. In order to overcome this drawback, Japanese Utility Model Application Laid-open No. 59-32090 discloses a resin window frame for which a wooden core member is used as reinforcing means. However, it is pointed out that this technique has the following problem on the window frame.

If the wooden core member is used as the reinforcing means for the resin window frame in place of metal, the drawback when the metal member is used as the reinforcing meams can be greatly improved. However, when a resin layer has small thickness, e.g. 2 to 5 mm, it would be partially swollen or finely cracked if it is used for a long period of time under such a condition that temperature varies greatly. Therefore, the external appearence of the window frame becomes inferior, or water invades the gaps between the resin layer and the core member due to the occurrence of swelling or cracks, so that the mechanical strength of the core member and also the window frame is lowered.

Accordingly, there has been required a resin window frame which suffers little deterioration in its external appearance and little reduction in mechanical strength when used under the above-mentioned severe condition during long time, and also has high mechanical strength.

SUMMARY OF THE INVENTION

As a result of deliberate considerations and earnest studies, the inventors of this application have found that if a wooden core member is coated with a resin material which is blended with fine powder of cellulose group, neither swelling nor cracks occur even when a heat cycle between high-temperature and low-temperature is repeated.

According to the present invention, there is provided a resin window frame comprising:

an outer frame member made of resin blended with cellulose-based fine powder, the outer frame member having a hollow portion; and a wooden core member having shape and size at least partially corresponding to the hollow portion of the outer frame member, wherein the wooden core member is engagedly inserted into the hollow portion of the outer frame member.

That is, according to the present invention, a resin window frame comprising an outer frame member which is formed in the shape of a window frame and has a hollow structure, and a wooden core member which has the shape and size corresponding to a hollow portion of the outer frame member and is engagedly inserted into the hollow portion of the outer frame member, is characterized in that the outer frame member is made of resin containing fine powder of cellulose group. In the present invention, a frame attached to the outer periphery of the window is also contained in the term "window frame".

According to the present invention, the problem of the resin window frame using the wooden core member can be overcome by using resin blended with fine powder of cellulose group for the resin outer frame member. The reason why the above-described problem can be overcome by the above means is not necessarily clear, however, it is estimated that if the outer frame member is molded with resin which is blended with fine powder of cellulose group serving as a main component of the wooden core member, the difference in thermal expansion coefficient between the outer frame member and the wooden core member is made small, and thus a stress due to heat cycle is lowered.

DETAILED DESCRIPTION OF THE PREFERRED EMBODIMENT

A preferred embodiment according to the present invention will be described with reference to the drawings.

Figure 1:
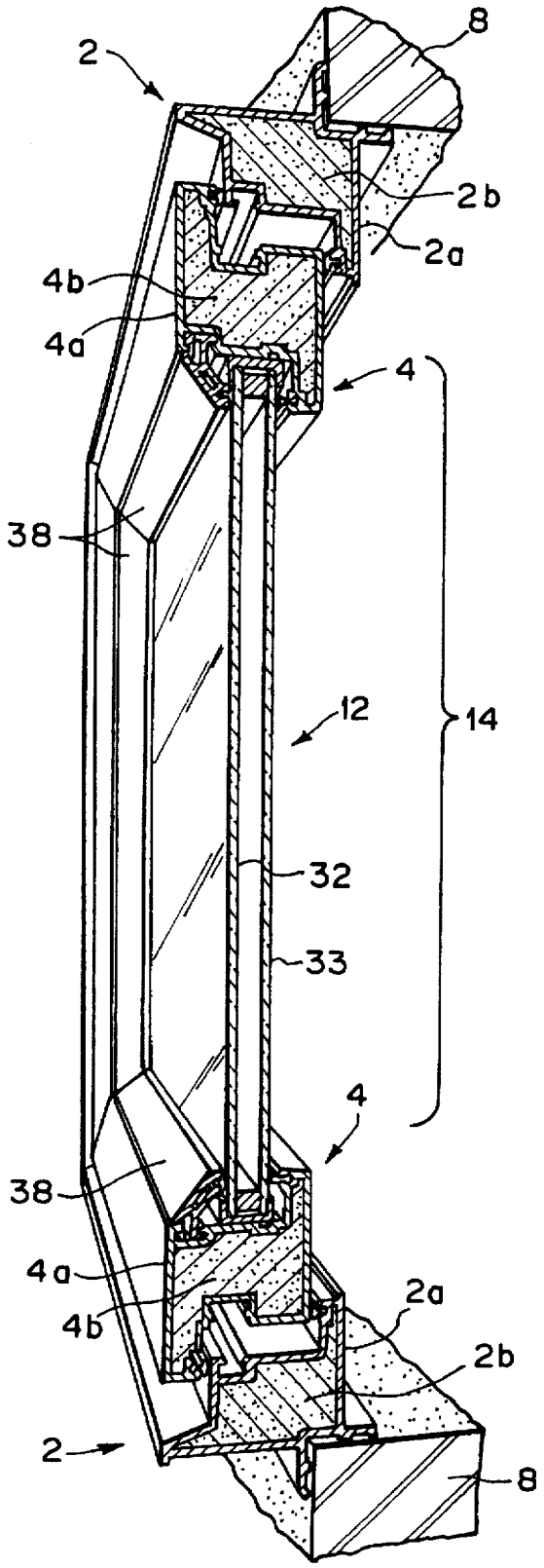
FIG. 1 is a cross-sectional view of a resin window frame according to the present invention.
Figure 2:
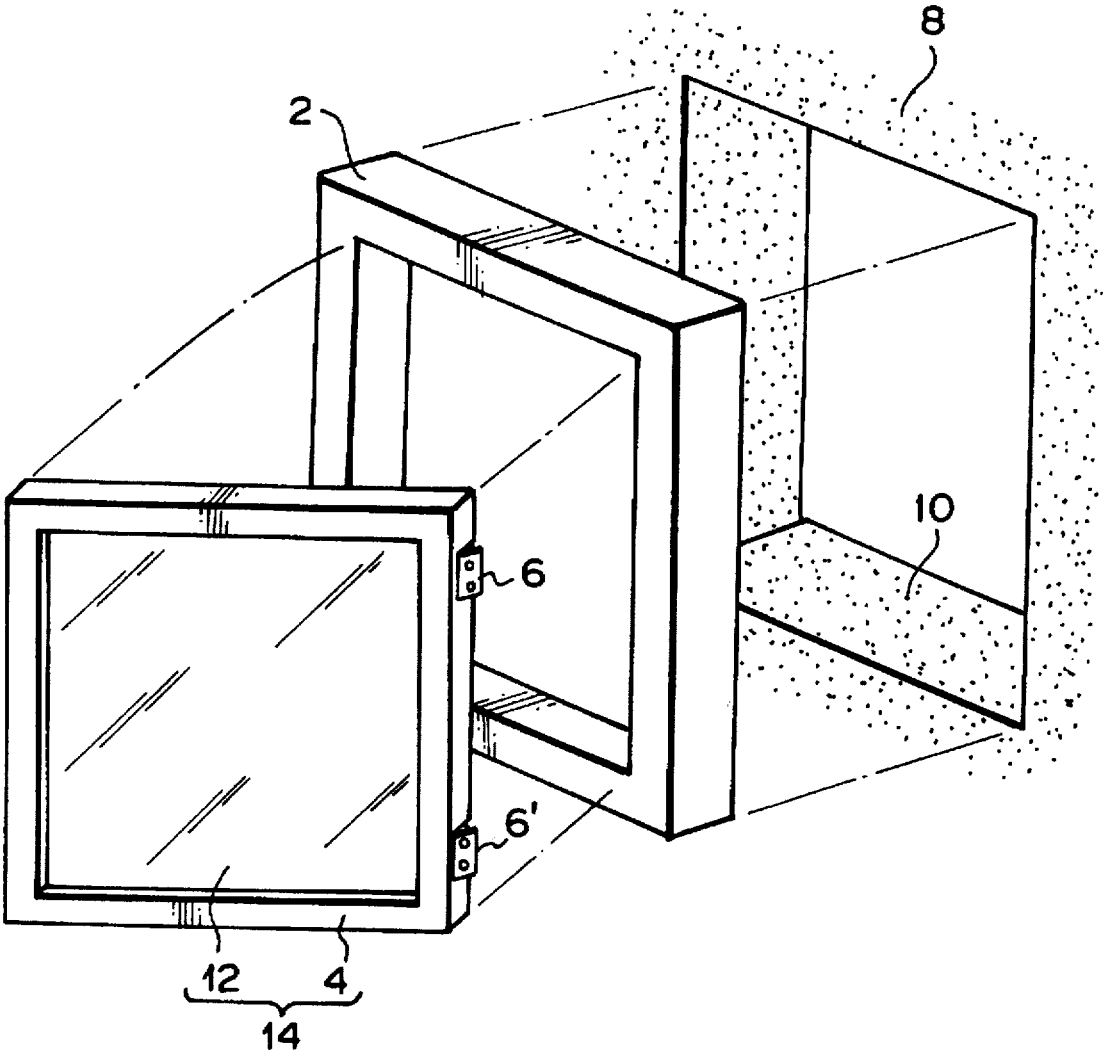
FIG. 2 is a schematic, exploded view showing the resin window frame according to the present invention.

FIG. 1 shows a resin window frame according to the present invention, and FIG. 2 is a schematic, exploded view thereof.

In FIGS. 1 and 2, reference numeral 2 denotes a first window frame, and 4 denotes a second window frame. The second window frame 4 is attached to an outer peripheral edge of a window glass 12 to form a window 14. The first window frame 2 is positioned around the second window frame member 4. As shown in FIG. 2, the second window frame 4 is attached to the first window frame 2 by means of hinges 6 and 6', so that the window 14 can be rotated around a vertical axis which is determined by the hinges 6 and 6' to allow the opening and closing motions of the window 14. The first window frame 2 is secured to an opening 10 of a wall 8 of a building by means of, for example, bolt (not shown).

Figure 3:
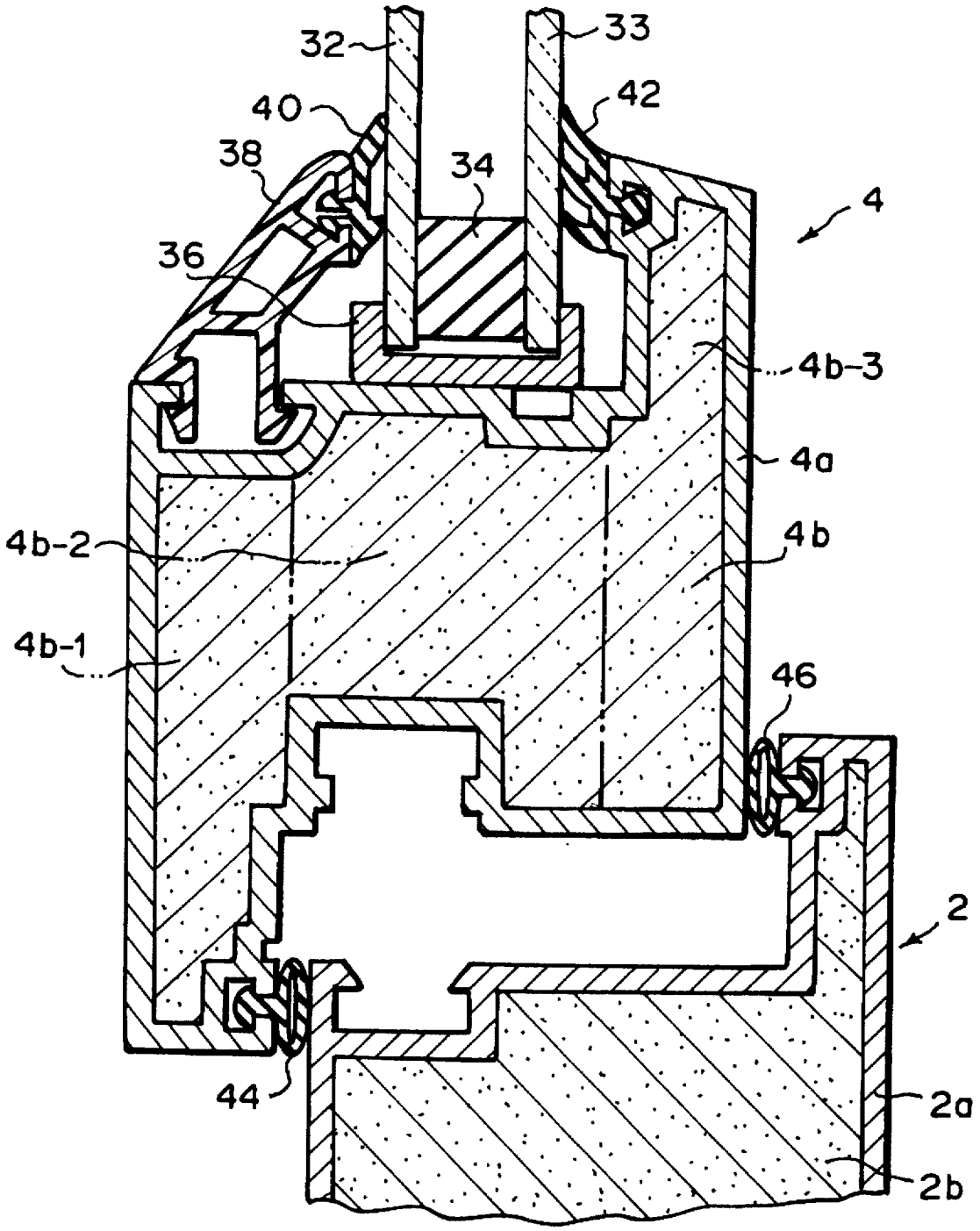
FIG. 3 is a partial, enlarged, cross-sectional view of the resin window frame of FIG. 1.

FIG. 3 shows a partial, enlarged cross section of the window frame of FIG. 1. The first window frame 2 comprises an outer frame member 2*a* made of resin and a wooden core member 2b, and the second window frame 4 comprises an outer frame member 4a made of resin and a wooden core member 4b. As shown in FIGS. 1 and 3, outer frame members 2a and 4a have a hollow structure. Into a hollow portion of the outer frame member 2a and 4a, the core members 2b and 4b are inserted to be tightly fitted. That is, a cross section of the hollow portion of the latter is substantially the same as a cross section of the former.

The outer frame members 2a and 4a are manufactured by molding resin blended with cellulose-based fine powder in the form of the hollow window frame. Any resin material may be used for the present invention insofar as the cellulose-based fine powder can be uniformly dispersed in the resin, and the resin can be molded into suitable shape. However, thermoplastic material is preferably used because it can be more easily molded and it facilitates uniform dispersion of the cellulose-based fine powder therein. For example, a vinyl chloride resin, polyethylene resin, polypropylene resin, ABS resin or the like may be used as the thermoplastic resin. Of these materials, vinyl chloride based resin such as vinyl chloride resin, graft polymer of ethylene-vinyl acetate copolymer and vinyl chloride or the like is particularly preferable.

The cellulose-based fine powder which is blended with the resin contains cellulose as a main component, and no restriction is imposed on a manufacturing method of the cellulose-based powder and the shape and particle size of the cellulose-based powder insofar as the powder does not remarkably damage the molding performance of the resin when it is blended with the resin. In the present invention, as the cellulose-based fine powder may be used those materials which are obtained by milling or pulverizing plant raw material such as wood, bagasse, straw or the like. When pulverized wood is used for the cellulose-based fine powder, the window frame having wood-like texture can be obtained. The particle size of the cellulose-based fine powder is generally within the range of about 1 to 1000 μm, and it is preferably within the range of about 10 to 200 μm with superior uniformity in consideration of uniform dispersibility of the powder into the resin. Furthermore, water contained in the cellulose-based fine powder causes foaming in a molding process, and thus it is preferable to sufficiently dry the fine powder so that the water can be reduced as much as possible before it is used. The blend amount of the cellulose-based fine powder within the resin is not limited to a special value, however, it is preferable to blend cellulose-based fine powder of 15 to 25 parts by weight into resin of 100 parts by weight. When the blend amount of the fine powder into the resin of 100 parts by weight is less than 15 parts by weight, no sufficient effect can be obtained in some cases. When the blend amount exceeds 25 parts by weight, the molding performance of the resin tends to be deteriorated.

In consideration of the physical properties of the finally obtained window frame, it is preferable that the cellulose-based fine powder is uniformly dispersed in the resin. Therefore, it is preferable that the cellulose-based fine powder is sufficiently mixed with powder or particles of the resin by Henschel mixer or the like before the molding process. At this time, stabilizer, pigment, dye, plasticizer, molding assistant or the like may be blended insofar as the effect of the present invention is maintained. The pigment may be carried on the cellulose-based fine powder in advance. The mixture of the cellulose-based fine powder and the resin powder (particles) thus obtained is molded into a hollow outer frame member having the shape of the window frame.

Figure 4:
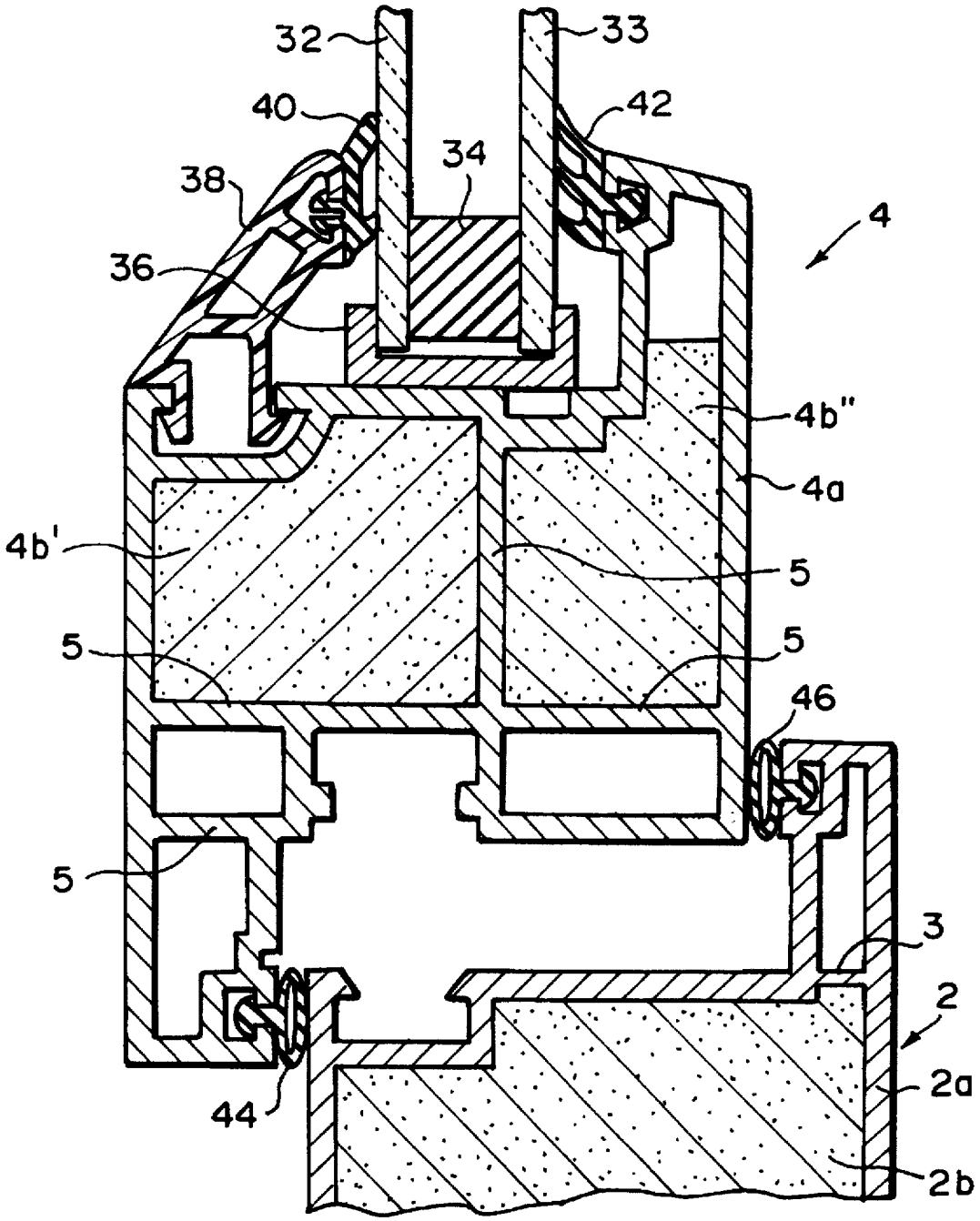
FIG. 4 is a partial, cross-sectional view of a resin window frame according to the present invention.

As shown in FIG. 4, one or more walls or partitions 3, 5 may be provided within the inner hollow portion of the outer frame member 2a, 4a to prevent deformation thereof or the like, so that the resin outer frame member may be designed to have a plurality of hollow portions (compartments). The wall or partition 3, 5 may extend along the lengthwise direction so as to form the plurality of hollow portions.

Further, in consideration of the facility of an engaging process for engagedly inserting the wooden core member into the hollow portion of the resin outer frame member, the resin outer frame member is generally molded in continuous lengths and then cut into pieces to obtain a plurality of window frame members for fabricating the window frame. As a molding method, an extrusion molding method, an injection molding method or other well-known molding methods may be used, and the method may be suitably employed in accordance with the characteristics of the resin, together with a molding condition. The resin outer frame member has a thickness, for example, of 0.5 to 10 mm and preferably 1 to 7 mm.

The wooden core members 2b, 4b used in the present invention have the shape and size which correspond to the hollow portion of the resin outer frame members 2a, 4a. In the window frame of FIG. 3, the resin outer frame members 2a, 4a each have one hollow portion receiving the wooden core members 2b, 4b respectively. The core member, however, is not necessarily formed as an unit body, and it may be fabricated by a plurality of parts each having a shape which is easily processed insofar as an assembly of these parts has the shape and size corresponding to the hollow portion of the resin outer frame members 2a, 4a. For example, as shown in FIG. 3, the core member 4b may comprise three parts 4b-1, 4b-2, 4b-3.

The wooden core member and the parts thereof may be formed by directly working a wooden rectangular timber, a log or the like. However, since the cross section of the window frame and the parts thereof generally have a complicated shape, so-called composite lumber or laminated lumber which is obtained by compressing and compacting wooden chips or the like together with adhesive or the like in a desired shape may be suitably used. When the composite lumber or laminated lumber is used for the wooden core member, there is not only an effect that the core member can be designed easily in a complicated shape, but also an auxiliary effect that the core member itself has high mechanical strength and also has little anisotropy. Furthermore, the wooden core member used in the present invention is preferably subjected to a rot proof treatment, a water proof treatment, a flame proof treatment, etc.

According to the resin window frame of the present invention, the wooden core member having the shape and size which are matched to those of the hollow portion of the outer frame member is engagedly inserted into the hollow portion of the resin outer frame member. When the resin outer frame member has a plurality of hollow portions as shown in FIG. 4, the wooden core member may be engagedly inserted into a main part of the whole hollow portion as shown in FIG. 4, and it is not necessarily required to be engagedly inserted into the overall hollow portion. The main part of the hollow portion means one or more parts of the whole hollow portion which occupy at a half or more of the whole sectional area of the overall hollow portion and would provide a sufficient reinforcing effect if the wooden core member is engagedly inserted into the main part. In FIG. 4, the wooden core members 4b', 4b" are used to occupy the main part of the overall hollow portion. Insofar as the sufficient reinforcing effect is obtained, the wooden core member, e.g. 4b", may have the cross section partially different from that of the part of the hollow portion.

Any well-known method may be used to engagedly insert the wooden core member into the hollow portion of the resin outer frame member if both the members are tightly fitted at least partially to each other. For example, the wooden core member may be directly inserted into the hollow outer frame member made of resin, or may be coated with adhesive on the surface thereof and then inserted into the hollow outer frame member made of resin.

Alternatively, both the wooden core member and the outer frame member may be integrally molded by a two-layer (co-) extrusion molding method so that the surface of the wooden core member which is beforehand processed to have the shape and size corresponding to those of the hollow portion of the outer frame member is coated with the resin blended with the cellulose-based fine powder as described above, whereby both the members can be engaged with each other while being kept in a close contact condition. Particularly, according to such an integral molding method, not only the resin outer frame member and the wooden core member can be brought into close contact with each other, but also the thickness of the resin outer frame member can be set to a small value. Therefore, this method is suitably used to industrially manufacture the resin window frame of the present invention.

In the integral molding method, it is also difficult to manufacture a window frame having a complicated shape at a time, and thus it is general to prepare a plurality of window frame members and fabricate those into the final window frame.

Figure 5A:
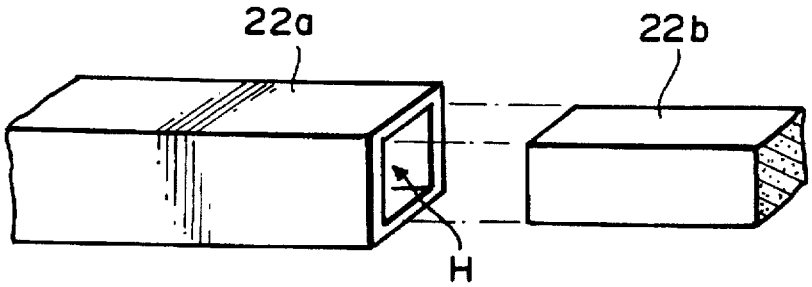
FIGS. 5A to 5C are diagram flow schematically showing a process for fabricating the resin window frame according to the present invention.
Figure 5B:
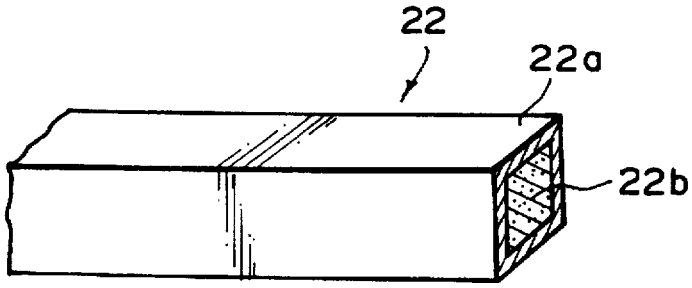
Figure 5C:
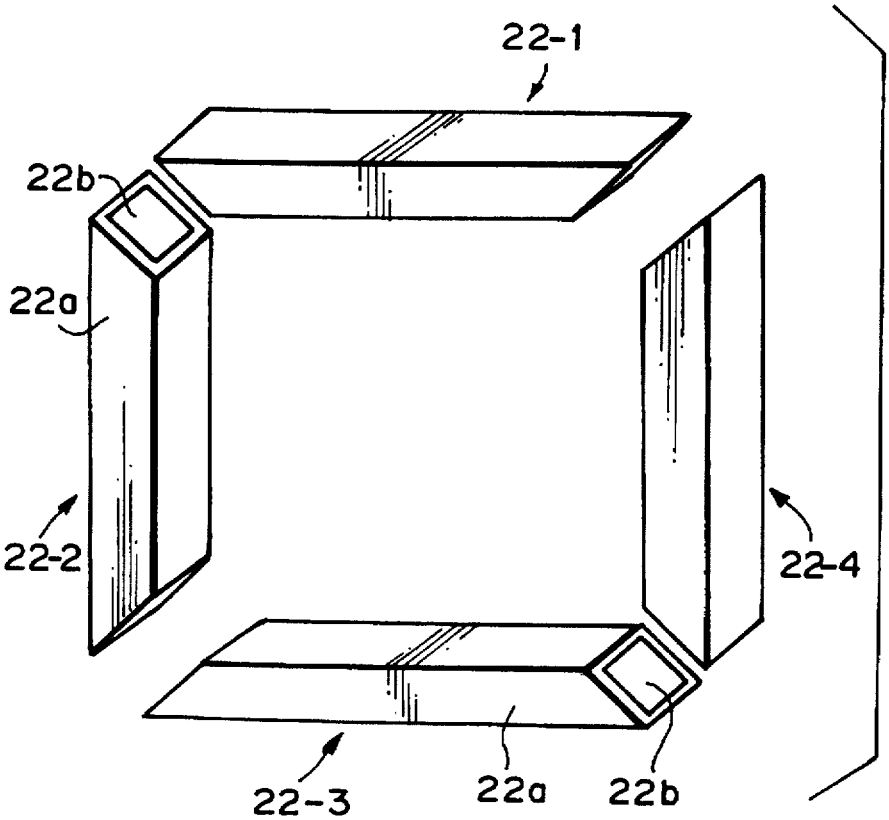

FIGS. 5A to 5C schematically show a process for fabricating the resin window frame according to the present invention. First, as shown in FIG. 5A, a wooden core member **22*b* and a resin outer member 22*a* having a hollow portion H are provided. Then, the wooden core member 22*b* is inserted into the hollow portion H of the resin outer member 22*a* to obtain a member 22 in continuous lengths as shown in FIG. 5B. Then, the member 22 is cut into pieces to obtain four window frame members 22-1, 22-2, 22-3, 22-4 as shown in FIG. 5C. Each frame member has oblique end surfaces. Finally, the window frame members 22-1, 22-2, 22-3, 22-4 are assembled by adhering the oblique end surfaces of the adjacent window frame members to obtain the above window frame 2 or 4** having rectrangular configuration.

As shown in FIGS. 1 to 4, when manufacturing the window 14, a window glass 12 such as a multilayered glass is attached to the window frame 4. In FIGS. 1, 3 and 4, reference numerals 32 and 33 each denote a glass plate, 34 a spacer positioned between the glass plates 32 and 33. Reference numeral 36 denotes a retainer positioned around the outer periphery of the glass plates 32 and 33. Reference numeral 38 denotes a batten attached to the resin outer frame member **4*a* of the window frame 4. Reference numeral 40 denotes a weather strip attached to the batten 38, and 42 a weather strip attached to the resin outer frame member 4*a* of the window frame 4. Reference numeral 44 denotes a cushioning attached to the resin outer frame member 4*a* of the window frame 4. Reference numeral 46 denotes a cushioning attached to the resin outer frame member 2*a* of the window frame 2. In the closed state of the window 14, the cushionings 44 and 46 are in contact with the surface of the resin outer frame members 2*a* and 4*a* of the window frame 2 and 4**, respectively.

The resin window frame fabricated as in the above can be secondarily processed insofar as the secondary processing does not spoil the effect of the present invention. The secondary processing means various surface treatments and processing such as coloring, patterning, emboss processing, etc. to improve the design, formation of a protecting layer to enhance resistance to fading and resistance to surface scratching, or fitting of accessories to improve the performance of the window frame such as packing performance, etc. Particularly, when the coloring or patterning is performed, the window frame suffers remarkable fading due to ultraviolet rays or the like, and thus it is preferable that the surface of the window frame is coated with acrylic resin or the like to prevent the fading.

Next, several experimental examples relating to the present invention will be described together with comparative examples to make the effect of the present invention clearer, however, the present invention is not limited by these examples. The effect of the present invention can be also confirmed by using a model test in place of actually forming the window frame, and thus the following examples and comparative examples were experimentally obtained by using model test pieces.

Examples 1 to 7 and Comparative examples 1 and 2

A rectangular member which was formed of composite lumber and designed to have a square section each side of which was equal to 3 cm in length was prepared as a core member. Further, vinyl chloride resin of 100 parts by weight was blended with cellulose-based fine powder (the blend amount of the powder is shown in Table 1) which was prepared from pulverized wood to have an average particle size of 100 μm and then sufficiently dried, thereby forming resin composition. The resin composition and the rectangular lumber were subjected to the two-layer extrusion molding to obtain a rod-shaped mold product which was coated with a resin layer on the surface thereof. The rod-shaped mold product was cut out to have a length of 10 cm, and then the cut faces at both ends thereof were lidded by the resin plates having the same composition as the coating resin layer. Thereafter, the resin plates were welded to the coating resin layer to form a model test piece. The thickness of the resin layer of the test piece thus formed is shown in Table 1. Fifteen test pieces were prepared for each of the examples and the comparative examples.

In each of the examples and comparative examples, after 15 test pieces were kept in a constant temperature bath of 23 degrees Centigrade for 48 hours, these were transferred into a constant temperature bath of 60 degrees Centigrade to allow to stand for 5 minutes at the same time, and then immediately transferred into a constant temperature bath of −20 degrees Centigrade to allow to stand for 5 minutes at the same time. This cycle was repeated at 20 times, and then five test pieces were selected from the 15 test pieces. Thereafter, the cycle of same treatment was further conducted on the residual ten test pieces at 30 times (totally 50 times), and then five test pieces were picked up from the 10 test pieces. Thereafter, the cycle of the same treatment was further conducted on the residual five test pieces at 50 times (totally 100 times). Each of the test pieces was evaluated by visually checking the external occurrence of swelling and fine cracks through eyes. The result is shown in Table 1. The numeral value in "evaluation" column represents the number of test pieces in which the swelling or the fine crack was observed, in the five test pieces which were subjected to the heat cycle at the same time.

TABLE 1

| Example No. | Blend amount of cellulose-based fine powder (parts by weight) | Thickness of resin layer (mm) | Evaluation Heat cycle 20 | 50 | 100 |
|---|---|---|---|---|---|
| 1 | 5 | 2 | 0 | 1 | 3 |
| 2 | 8 | 2 | 0 | 1 | 2 |
| 3 | 13 | 2 | 0 | 0 | 2 |
| 4 | 15 | 2 | 0 | 0 | 0 |
| 5 | 20 | 2 | 0 | 0 | 0 |
| 6 | 25 | 2 | 0 | 0 | 0 |
| 7 | 40 | 5 * | 0 | 2 | 3 |
| Comp. Ex. 1 | 0 | 2 | 1 | 2 | 4 |
| Comp. Ex. 2 | 0 | 5 | 2 | 4 | 5 |

Note: * . . . no good mold product was obtained when the thickness of resin layer was set to 2 mm As shown in Table 1, when the heat cycle of high-temperature and low-temperature was carried out repeatedly, the deterioration of the external appearance of the test pieces of each example according to the present invention which was formed by using the resin which was blended with the cellulose-based fine particles was extremely less than that of the test pieces of each comparative example which was prepared by using resin blended with no cellulose-based fine particle. This result shows that the resin window frame according to the present invention is more excellent in durability under a severe natural condition than the conventional resin window frame having the wooden core member.

What is claimed is:

1. A resin window frame comprising:

an outer frame member made of resin blended with cellulose-based fine powder, said outer frame member having a hollow portion; and a wooden core member having shape and size at least partially corresponding to said hollow portion of the outer frame member, wherein said wooden core member is engagedly inserted into said hollow portion of the outer frame member.

2. The resin window frame as claimed in claim 1, wherein said outer frame member is made of thermoplastic resin blended with the cellulose-based fine powder of 15 to 25 parts by weight to said resin of 100 parts by weight.

3. The resin window frame as claimed in claim 2, wherein said thermoplastic resin is one of vinyl chloride resin and graft polymer of ethylene-vinyl acetate copolymer and vinyl chloride.

4. The resin window frame as claimed in claim 1, wherein said cellulose-based fine powder is one of pulverized wood, pulverized bagasse and pulverized straw.

5. The resin window frame as claimed in claim 1, wherein said cellulose-based fine powder has a particle size within the range of 1 to 1000 μm.

6. The resin window frame as claimed in claim 1, wherein said outer frame member has a thickness within the range of 0.5 to 10 mm.

7. The resin window frame as claimed in claim 1, wherein said outer frame member has a wall which divides said hollow portion into a plurality of compartments.

* * * * *